United States Patent [19]

Hammoud

[11] Patent Number: 4,604,025

[45] Date of Patent: Aug. 5, 1986

[54] POSITION INDICATOR FOR A MATERIAL HANDLING ELEMENT OF A MACHINE

[75] Inventor: Ezzat A. Hammoud, Libertyville, Ill.

[73] Assignee: Dresser Industries, Inc., Dallas, Tex.

[21] Appl. No.: 659,058

[22] Filed: Oct. 9, 1984

[51] Int. Cl.[4] ..... B66F 11/00

[52] U.S. Cl. ..... 414/698; 33/521; 116/DIG. 13; 116/DIG. 41; 116/230; 356/138; 414/722

[58] Field of Search ..... 414/698, 722; 37/DIG. 19; 116/28, DIG. 13, DIG. 41, 230; 33/521; 356/138, 153, 399

[56] References Cited

U.S. PATENT DOCUMENTS

| | | | |
|---|---|---|---|
| 2,191,323 | 2/1940 | Richter | 37/DIG. 19 X |
| 2,205,490 | 6/1940 | Peterson | 37/DIG. 19 X |
| 2,808,017 | 10/1957 | Killebrew | 37/DIG. 19 X |
| 2,991,570 | 7/1961 | Resler | 37/DIG. 19 X |
| 3,017,046 | 1/1962 | Runci et al. | 414/698 |
| 3,796,335 | 3/1974 | Smith et al. | 414/698 |
| 4,309,142 | 1/1982 | Shumaker | 414/698 X |
| 4,391,563 | 7/1983 | Vietor | 414/698 |

*Primary Examiner*—Leslie J. Paperner
*Assistant Examiner*—Lyle Kim
*Attorney, Agent, or Firm*—John N. Hazelwood; Barry E. Deutsch

[57] ABSTRACT

A mobile material handling machine includes a material handling element and an operator's control cab. A plate is pivotally attached to the material handling element in line with the operator's line of sight from the cab towards the element. The plate has first indicia on the edges thereof; second indicia on the top surface thereof; and third indicia on the bottom surface thereof. The first indicia is in line with the operator's line of sight when the material handling element is positioned at a predetermined angle relative to the operator's cab.

4 Claims, 3 Drawing Figures

POSITION INDICATOR FOR A MATERIAL HANDLING ELEMENT OF A MACHINE

BACKGROUND OF THE INVENTION

This invention relates to a material handling machine having a material handling element, and in particular, to means for indicating the position of said material handling element relative to the operator's cab of said machine.

Mobile material handling machines, such as front end loaders, include a material handling element such as a bucket. Such material handling machines typically include a vertically adjustable boom structure pivotally connected at one end to the machine, and pivotally supporting at the other end thereof the element which is adapted to dig, carry and discharge a load. Various types of tilt mechanisms or linkages have been developed for controlling tilting movement of the element on the boom for the purpose of disposing the element in various positions, such as digging and dumping positions, to receive and discharge a load respectively.

In material handling machines of the type described, a particular problem is encountered by the operator in properly positioning the material handling element when the element is in a low-level position. This problem manifests itself irrespective of the particular type of tilt or support linkage involved. The problem is presented due to the fact that the linkage connecting the boom and material handling element extends forwardly from the machine's operator's cab and obstructs the operator's view of the material handling element when it is in its low level position. Accordingly, the operator experiences difficulty in properly positioning the element in a selected position such as, for example, a low-level digging position. Specifically, the bottom and cutting edges of the material handling element are usually invisible to the operator. Operations such as stripping and clean-up, which require the material handling element to be level, become very difficult to perform effectively due to the described problem.

Prior attempts to overcome the described problem includes placing a wide horizontal line on the material handling element. The line is in the operator's line of sight. Relative change in the width of the line roughly indicates the relative position of the material handling element with respect to the underlying ground. This method is neither accurate nor does it assure positive indication of direction of the tilt of the material handling element.

In U.S. Pat. No. 3,017,046, there is disclosed a bucket position indicator utilizing a cam provided with two cam surfaces. A cam follower rides along the cam surface during movement of a bucket tilt jack. The cam follower causes the movement of an indicator relative to an indicia point. The indicia marker is set so that when the pointer reaches alignment with the indicia, tilt jack retraction is discontinued by the operator and the bucket is in the position to resume digging operations when the boom is lowered. This device is vulnerable to damage since it is located on the top of the material handling operating cylinder. The device is relatively complex and expensive to manufacture. The altitude of the material handling element is indicted indirectly through movement of the material handling element cylinder rod. Such movement has a non-linear relationship with the altitude change of the material handling element. The cam, cam follower and spring are susceptible to wear. The same size device could not be used for different size machines, which is a further limitation.

In U.S. Pat. No. 4,309,142, there is disclosed apertures provided through the material handling element so that the operator's line of sight will locate the leading edge of the element. Alternatively, a mirror is provided at an upper edge of the material handling element and is attached to the edge of the element by an integral bracket. The mirror is positioned to enable the driver or operator to see the reflection of the leading edge of the element. Like the other prior art devices heretofore discussed, this arrangement also suffers from multiple deficiencies. For example, once the cutting edge of the material handling element is embedded in the ground, it is impossible to know the altitude of the element. When apertures are provided through the element, special reinforcement of the element must be added to maintain structural integrity thereof. When a mirror is employed, it is extremely vulnerable to damage. In large machines, visibility would be very poor due to the increased distance between the operator's cab and the cutting edge of the element. The apertures in the element will most likely become plugged with material. This arrangement further requires sufficient illumination to enable the operator to see the reflection of the element, or to see through the apertures. If the mirror embodiment is employed, this arrangement is relatively complex and expensive.

Accordingly, it is an object of the present invention to enable the machine's operator to visually monitor the position of the material handling element through a relatively simple, easily maintained, and highly accurate arrangement.

SUMMARY OF THE INVENTION

The foregoing object is attained in a material handling machine having a material handling element and an operator's control cab. A plate is pivotally attached to the material handling element in line with the operator's line of sight from the cab towards the element. The plate has first indicia means on the edges thereof, second indicia means on the top surface, and third indicia means on the bottom surface. The first indicia means is in line with the operator's line of sight when the material handling element is positioned at a predetermined angle relative to the operator's cab. The second or third indicia means are in line with the operator's line of sight when the material handling element is inclined relative to the predetermined angle respectively in first or second directions.

DESCRIPTION OF THE PREFERRED EMBODIMENT

Figure 1:
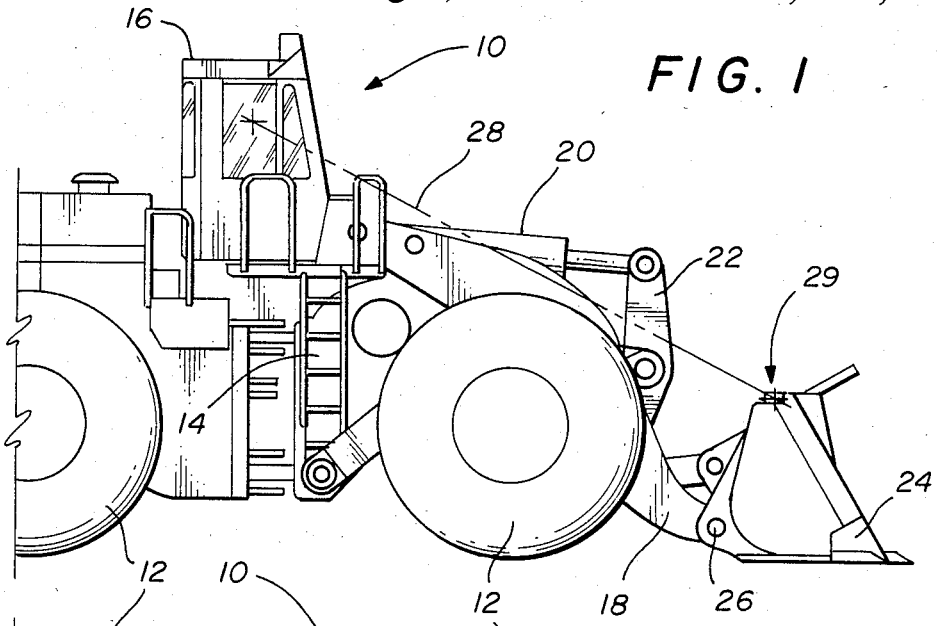
FIG. 1 is an elevational view of a material handling machine including the present invention.

Referring now to the drawing, there is disclosed a preferred embodiment of the present invention. In referring to the various figures of the drawing, like numerals shall refer to like parts.

Figure 2:
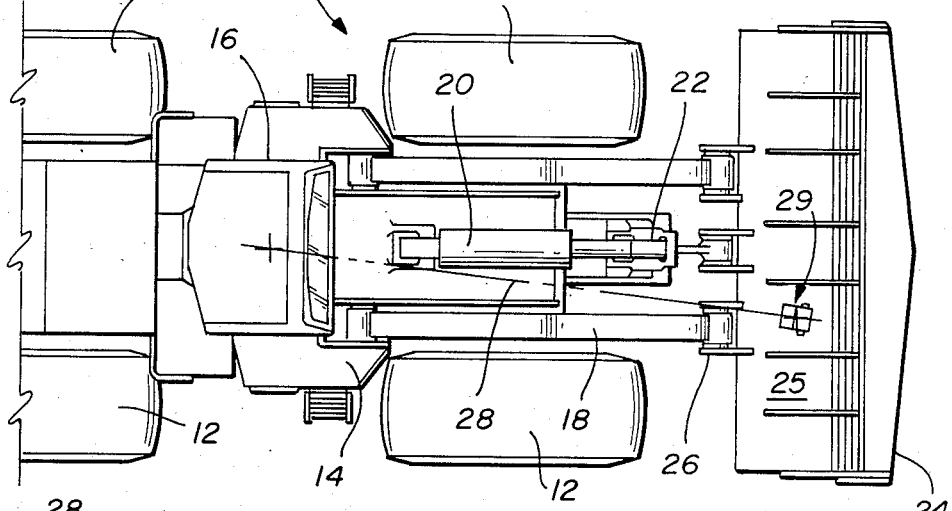
FIG. 2 is a top plan view of the machine of FIG. 1 further illustrating the present invention.

Referring specifically to FIGS. 1 and 2, there is illustrated a mobile material handling machine of the type in which the present invention finds particular utility. The illustrated mobile material handling machine is a wheeled, front end loader 10. Loader 10 is movably supported upon the underlying ground by wheels 12. Loader 10 includes a frame 14 having an operator's cab 16 mounted thereon. Loader 10 further includes a material handling element, such as bucket 24. The bucket is adapted to dig, carry and discharge a load. The angle of the bucket relative to the underlying ground may be varied in accordance with the specific function of the bucket at a given time. Bucket 24 is pivotally attached by a pivot pin 26 to vertically adjustable boom 18. The adjustment means for boom 18 includes linkage 22 and pivotable piston 20 connected thereto.

In front end loaders, and other similar types of material handling machines, the operator located in cab 16 may have difficulty in properly positioning the bucket or similar material handling element when the element is in a "low level" position. The problem is presented due to the fact that the linkage connecting the boom and material handling element extends forwardly from the front of cab 16 and thereby obstructs the operator's view of the bucket, when the bucket is in its low level position. Specifically, the bottom and cutting edges of the material handling element are usually invisible to the operator. Particular operations such as stripping and clean up, which require the bucket to be level, become very difficult to perform effectively in view of the described problem. Line 28 represents the general line of sight of an operator when the bucket is in its low level position.

Figure 3:
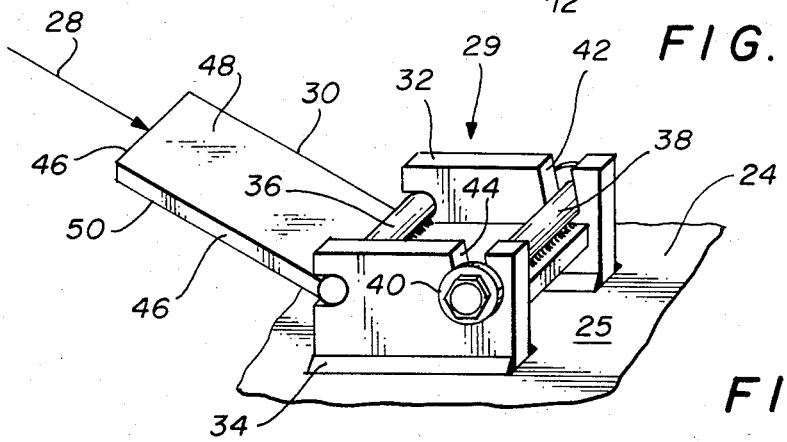
FIG. 3 is a perspective view of the invention taken along line III—III of FIG. 2.

To overcome the aforedescribed problem, position indicator 29 of the present invention is attached to surface 25 of bucket 24. Details of indicator 29 are specifically shown in FIG. 3. Indicator 29 includes plate 30 pivotally connected via pivot pin 36 to a pair of brackets 32, 34. The brackets are attached by welding or other suitable means to surface 25 of bucket 24. Arcuate slots 42, 44 are formed respectively in each bracket 32, 34 and a bolt or other similar device 38, is attached to plate 30 and mounted for movement within the slots. Washers and a nut or other similar means 40 are provided to maintain the bolt within the arcuate slots.

Edges 46 of plate 30 are provided with first indicia means. Top surface 48 of the plate is provided with second indicia means, and bottom surface 50 is provided with third indicia means. The indicia means may comprise different colors or other readily discernible objects. For example, in the preferred embodiment, the first indicia means on edges 46 are provided by painting the edges the same color as the bucket. Top surface 48 is painted a second color to provide the second indicia means, and bottom surface 50 is painted still a third color to provide the third indicia means.

Since line of sight 28 may be different for each operator, depending upon the height of the operator, plate 30 is initially adjusted by being pivoted about pin 36 so that when bucket 24 is positioned at a predetermined angle relative to the operator's cab, the operator will only view the first indicia means provided on edges 46 of plate 30. Thereafter, when the bucket is disposed at the predetermined angle at any time during operation of the machine, the operator will only view the first indicia means. During operation, when the bucket is inclined relative to the predetermined angle in a first direction, the operator will view the second indicia means, and when the bucket is inclined in a second direction, the operator will see only the third indicia means. During such operation, if the operator sees the first indicia means, he knows that the bucket is at the predetermined angle. If, on the other hand, he desires the bucket to be at the predetermined angle, but in viewing indicator 29, sees either the second or third indicia means, he knows that he must rotate bucket 24 about pivot 26 in specific direction until he no longer sees either the second or third indicia means and sees only the first indicia means.

The position indicator of the present invention is relatively inexpensive to manufacture, rugged since it involves non-complex components, and highly accurate since it is positioned directly on the bucket, and may be adjusted to compensate for different lines of sight for different operators or different tire sizes. Further, the same indicator may be used on different bucket sizes.

While a preferred embodiment of the present invention has been described and illustrated, the invention should not be limited thereto but may be otherwise embodied within the scoped of the following claims.

The embodiments of the invention in which an exclusive property or privilege is claimed are defined as follows:

1. In a mobile material handling machine including a material handling element and an operator's control station which provides a line of sight between an operator positioned thereat and the material handling element, the improvement comprising:

a plate having an edge and an upper surface and a lower surface and being pivotally attached to said material handling element in line with the operator's line of sight from said station toward said element, said plate having first indicia means on its edge, second indicia means on its top surface and third indicia means on its bottom surface, said first indicia means being in line with the operator's line of sight when said material handling element is positioned at a predetermined angle relative to said operator's control station, said second or third indicia means being in line with the operator's line of sight when the material handling element is inclined relative to said predetermined angle in respectively first or second directions.

2. In a material handling machine in accordance with claim 1 wherein said element is a bucket.

3. In a material handling machine in accordance with claim 1 wherein the plate is initially pivoted relative to said material handling element to align said first indicia means with said operator's line of sight when the element is positioned at said predetermined angle to accommodate different sizes of material handling elements and different operator's lines of sight from said station.

4. In a material handling machine in accordance with claim 1 wherein said element is painted a first color, and said indicia on said edge of said plate is painted said first color, said indicia on said top surface a second color and said indicia on said bottom surface a third color.

* * * * *